United States Patent [19]

Hashimoto

[11] Patent Number: 4,828,050

[45] Date of Patent: May 9, 1989

[54] SINGLE PASS DRILLING APPARATUS AND METHOD FOR FORMING UNDERGROUND ARCUATE BOREHOLES

[75] Inventor: Tom T. Hashimoto, Conroe, Tex.

[73] Assignee: Branham Industries, Inc., Conroe, Tex.

[21] Appl. No.: 148,111

[22] Filed: Jan. 28, 1988

Related U.S. Application Data

[63] Continuation of Ser. No. 861,080, May 8, 1986, abandoned.

[51] Int. Cl.[4] ..... E21B 7/08

[52] U.S. Cl. ..... 175/45; 175/61; 175/94

[58] Field of Search ..... 175/45, 53, 61, 62, 175/71, 73, 94, 103, 162, 171, 203; 405/184

[56] References Cited

U.S. PATENT DOCUMENTS

| | | | |
|---|---|---|---|
| 2,194,267 | 3/1940 | Brock et al. | 175/61 |
| 2,565,794 | 8/1951 | Young | 175/65 X |
| 3,811,519 | 5/1974 | Driver | 175/73 |
| 3,830,545 | 8/1974 | Sugden | 175/62 X |
| 3,845,828 | 11/1974 | Taylor et al. | 175/73 |
| 3,958,648 | 5/1976 | Grönblad | 175/171 X |
| 3,961,673 | 6/1976 | Wolters et al. | 175/210 X |
| 3,993,127 | 11/1976 | Chepelev et al. | 175/61 X |
| 4,026,371 | 5/1977 | Takada et al. | 175/73 X |
| 4,047,582 | 9/1977 | Appleman | 175/171 X |
| 4,166,509 | 9/1979 | Ueno et al. | 175/94 |
| 4,221,503 | 9/1980 | Cherrington | 405/184 |
| 4,354,559 | 10/1982 | Johnson | 175/71 |
| 4,527,837 | 7/1985 | Snyder | 175/61 X |
| 4,576,515 | 3/1986 | Morimoto et al. | 405/184 |

*Primary Examiner*—Jerome W. Massie
*Assistant Examiner*—Matthew Smith
*Attorney, Agent, or Firm*—Dodge, Bush & Moseley

[57] ABSTRACT

In accordance with an illustrative embodiment of the present invention, a cased borehole is drilled under surface obstructions in a single pass operation. The drilling apparatus includes a rotary drill bit mounted on a guide head having a ball joint connection to a housing. Remote controlled hydraulic cylinders enable steering of the guide head and bit, so that the hole direction can be controlled at will. Casing sections connected to the housing are added end-to-end as the borehole is lengthened, and axial thrust is applied to the casing string at the borehole entrance by a drilling rig to force the bit against the formations. The bit is driven by drill pipe that is centralized within the casing, so that when the bit, guide head and housing emerge from the ground, these elements can be disconnected, and the drill pipe pulled out of the casing to leave an unobstructed, lined borehole that is formed in a single pass.

40 Claims, 4 Drawing Sheets

SINGLE PASS DRILLING APPARATUS AND METHOD FOR FORMING UNDERGROUND ARCUATE BOREHOLES

This application is a continuation of application Ser. No. 861,080, filed May 6, 1986, now abandoned.

FIELD OF THE INVENTION

This invention relates generally to methods and apparatus for drilling a borehole between surface, or near-surface, locations on opposite sides of a surface obstruction such as a roadway, waterway, or building, and particularly to new and improved methods and apparatus of the type described where the borehole is drilled and lined with a casing in a single pass operation.

BACKGROUND OF THE INVENTION

In known drilling operations of the type described generally above, a pilot hole is drilled along an inverse arcuate path by means of a rotary drill bit powered by a drill string having a bent sub connected therein. The drill can be "walked" right or left, or up or down by controlling the orientation of the bent sub, and varying the thrust on, and the rpm of, the bit. Once a pilot hole has been established between locations on opposite sides of the obstruction, a reamer that advances concentrically along the drill pipe is used to enlarge the hole, with the reamer being followed by a liner string of casing that acts to prevent collapse or cave-in of the borehole walls. When the following liner is completely in place, the drill pipe is withdrawn from the borehole to provide an unobstructed passage.

Although the foregoing procedure has been widely used, it has the principal disadvantage that a plurality of passes is required to complete the borehole, with attendant difficulties and expense. A long, open excavation is required at the entrance end to enable welding the entire liner string together, since it must be pulled through the hole behind the reamer. Moreover, the manner that has been employed to control the direction of the hole involves a degree of guesswork coupled with repeated "single-shot" directional surveys to determine, after the fact, where the outer end of the pilot hole may be.

An object of the present invention is to provide new and improved methods and apparatus for drilling and lining a borehole that extends underneath an obstruction and between surface locations on opposite sides thereof.

Another object of the present invention is to provide new and improved methods and apparatus of the type described where a lined borehole is formed with a single pass of equipment and instrumentation.

Another object of the present invention is to provide new and improved methods and apparatus of the type described where individual short sections of casing are joined end-to-end during a single pass operation, which gives the present invention great advantage in urban operations under crowded conditions.

Still another object of the present invention is to provide new and improved methods and apparatus of the type described where directional guidance is imparted to the drill bit throughout the hole forming operation so that the path of the borehole is very precise.

SUMMARY OF THE INVENTION

These and other objects of are attained in accordance with the present invention through the provision of a borehole drilling apparatus comprising a rotary drill bit connected to a hollow shaft that extends into a tubular guide head. The guide head has a ball joint connection to a tubular housing located rearwardly thereof, and a bit drive shaft that is mounted concentrically within said housing has its forward end connected to the rear of the bit shaft by a cardan or "universal" joint. A flexible hose couples the adjacent shaft ends together to enable circulation of a drilling medium that cools the bit and carries away cuttings.

In order to steer the bit from a remote location so as to cause the borehole to be drilled along a predetermined course, hydraulic cylinder means are pivotally connected between the tubular housing and the guide head. The cylinder means are operable upon command to control the altitude of the guide head and bit relative to the following housing. A directional sensor, such as a combination of accelerometers and magnetometers, is mounted on a fixed frame inside the guide head, and provides continuous output signals that are representative of the azimuth and inclination of the axis of rotation of the bit.

Extending rearwardly of the tubular housing is a series of casing sections welded end-to-end. Each casing section has an outer diameter that is slightly less than the diameter of the bit. A string of drill pipe having a plurality of joints that are threaded end-to-end, extends throughout the casing sections, and a plurality of centralizers are used to mount the drill pipe string concentrically therein. The centralizers each have shoes that slidably engage inner wall surfaces of the casing so as to be readily movable along the casing.

An air hose may be positioned within the casing, with the front end of the hose in communication with the jet nozzles on the bit. Pressurized air emanating from the nozzles cools the bit, and the high velocity air flow carries cuttings back through the bore of the drill pipe to the outer end thereof. Ground water that collects in the borehole can be aspirated into the drill pipe by the air flow so as to be continuously removed from the borehole.

The above-ground portion of the apparatus of the present invention includes a portable drilling rig comprising a casing thruster assembly and drill pipe drive components. The rig can have a trailer-mounted platform that carries track upon which a train is longitudinally movable. The rear portion of the platform carries a pipe inlet cup that is used to seal off the annular area between the casing and the borehole wall. The cup may include a stripper rubber through which the casing sections are inserted. The platform also may be provided with rollers for supporting the casing sections, and an automatic welding machine to join adjacent casing sections end-to-end.

The front of the train carries a casing cup to which the rod ends of a pair of powerful hydraulic jacks are attached. The cylinder ends of the jacks are connected to a bracket on the front end of the platform, so that extension of the jacks will cause axial thrust to be applied by the cup to the casing. The outer section of drill pipe extends through the casing cup, and is connected to a splined drive shaft that is mounted on the train. The drill pipe drive shaft is adapted to be rotated via suitable gears that are driven by one or more motors. Thus the drill string is rotated to correspondingly rotate the bit, as axial thrust is applied to the casing to which the guide head and bit are attached.

In accordance with the methods of the present invention, a cased borehole that extends along a curved path underneath a surface obstruction is formed by thrusting a rotary drill bit on the outer end of a guide assembly against the earth formations at the end of the borehole. The guide assembly is attached to a following casing to which axial force is applied by jacks located near the borehole entrance. Simultaneously, a drill pipe which extends through the casing and is coupled to the bit is rotated in order to correspondingly rotate the bit, while compressed air that is pumped through hoses exits the jets in the bit to return the cuttings through the bore of the drill pipe. The casing is formed of individual sections which are added end-to-end when the outermost section of casing has been advanced to a point near the borehole entrance. Then, the jacks are retracted to enable an additional section of casing, and an additional section of drill pipe, to be added, together with additional lengths of air hose and additional drill pipe centralizers. Then the jacks are extended, and the drill pipe rotated, to lengthen the borehole.

As the borehole is formed, a directional sensor package in the guide head provides continuous signals representative of the azimuth and inclination of the rotation axis of the bit. This data can be used to provide an accurate map of the trajectory of the borehole, and a system of steering cylinders in the guide assembly can be selectively activated when and as a course connection is needed.

When the drill bit and guide assembly emerge from the ground on the opposite side of the obstruction, the bit and guide are removed. Then the drill pipe, centralizers and supply lines are pulled out of the casing through operation of the jacks, leaving the casing in place to line the walls of the borehole. The entire hole drilling and casing operation takes place in a single pass of the equipment through the earth.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF PREFERRED EMBODIMENTS

Figure 1:
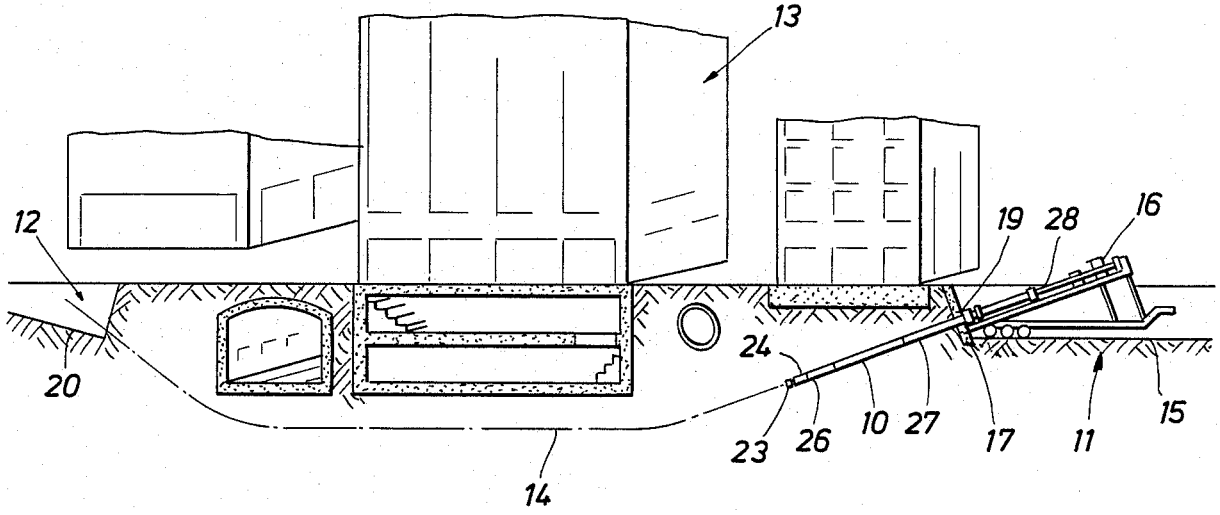
FIG. 1 a schematic view of a drilling operation being conducted in accordance with the present invention.

Referring initially to FIG. 1, a drilling operation is shown schematically for drilling and casing a generally inverse arcuate borehole 10 that extends from a first location 11 to a second location 12 along a path that passes underneath various surface obstructions 13, which may be office buildings, subways, streets, a river, a freeway or the like. The path 14 of the borehole is shown in phantom lines, have a relatively complex curvature, as shown, where necessary, or it can be a shallow arc. The location 11 typically will be prepared by making an excavation 15 of a length, width and depth sufficient to receive a trailer-mounted drill rig 16 that is backed into position such that the rear end of the trailer is adjacent to a retainer wall 17 which can be formed by concrete. The wall 17 is poured with a pilot opening 19 therein having an inclination with respect to vertical, and an azimuth with respect to magnetic north, such that the borehole 10 will be started out in a desired direction.

The excavation 15 need only have sufficient dimensions to receive the trailer-mounted drill rig, due to the unique manner in which the casing string is formed as the borehole 10 is drilled. In prior systems where the casing or liner is pulled through behind a reamer in a second pass through a previously drilled pilot hole, the liner string must be made up to its full length prior to pulling. This requires a long open work space, which can be a significant problem where drilling is done in urban or suburban areas.

The location 12 where the borehole 10 is to come out of the ground also can be excavated at 20 so that equipment that is used to receive and dismantle the front portion of the drilling apparatus, after it emerges from the ground, can be driven into position. As used herein, the terms "surface" and "near-surface" are intended to encompass starting and ending locations for the borehole 10 that are either at ground level, or are in a depression that is excavated to extend somewhat below but near ground level.

Figure 2A:
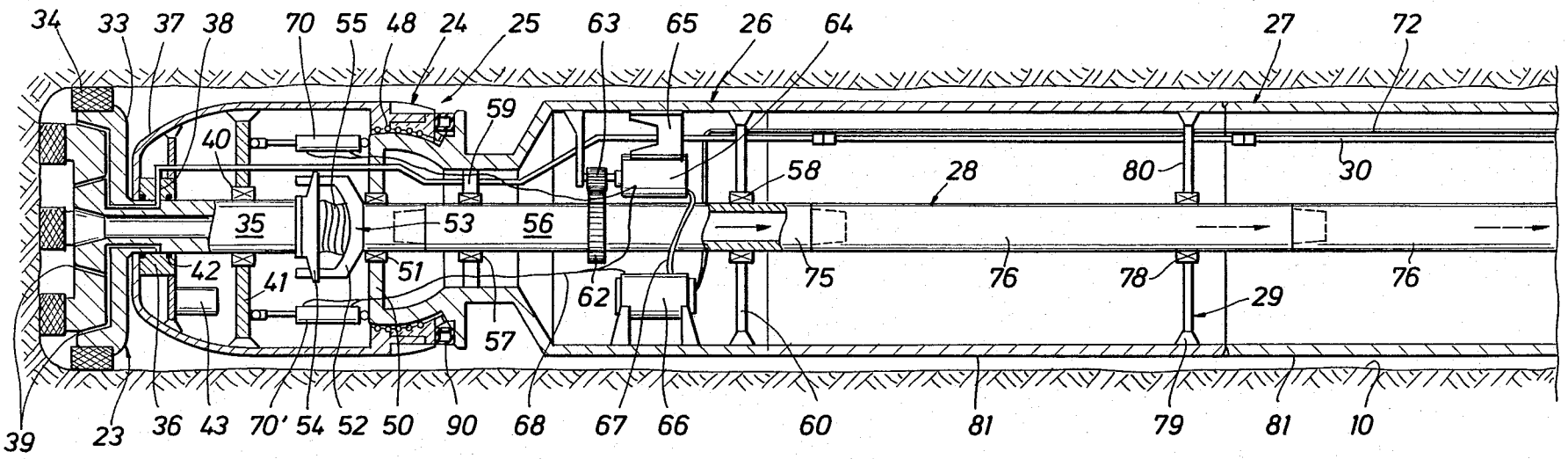
FIGS. 2A–2B are longitudinal sectional views, with some portions in side elevation, of the underground portion of the drilling apparatus of FIG. 1.

As shown in FIG. 2A, the borehole 10 has been started at a shallow inclination down into the ground, with the hole being formed by a rotary bit 23 that is mounted on a guide head 24. The guide head 24 has a ball joint connection 25 to a following housing 26. The rear of the housing 26 is fixed to the front joint of a string of large diameter casing 27. The casing 27 is thrust into the borehole as it is formed by the bit 23, and lines the walls in order to prevent collapse or caving-in of the borehole behind the bit. The bit 23 is driven by a string of smaller diameter drill pipe 28 having a plurality of short sections connected end-to-end by threaded pin and box members. The drill string 28 is supported and centralized in the casing string 27 by axially spaced centralizers 29 that are removably mounted in the casing as will be described in greater detail below.

In order to cool the bit 23 and carry away rock cuttings, a suitable medium such as compressed air is pumped through a line 30 that extends within the casing 27, the line 30 continuing through the housing 26 and the head 24 where it is connected with outlet ports or jets 39 in the body of the bit 23. Air emanating from the jets 39 carries the cuttings through a central opening in the bit 23 and into the bore of the drill pipe 28 where they are circulated back to the drill rig 16 for collection or discarding, and if desirable, geological analysis. Should there by any ground water that collects in the borehole as it is formed, the water will be aspirated into the bore of the drill pipe 28 and conveyed by the air flow to the drill rig 16 where it can be disposed of, much in the nature of a reverse circulation process.

As shown in further detail in FIG. 2A, the underground portion of the structure of the present invention includes the drill bit 23 that has a body 33 on which are mounted rolling-type cutters 34. The body 33 is mounted on a shaft 35 that extends through a bearing 36 on the nose 37 of the guide head 24. Suitable seals are provided to prevent fluid leakage, and the bearing 36 has a plurality of radial ports 38 to which the forward end of the air line 30 is connected. The ports 38 are communicated by axial and outwardly inclined channels to the jets 39. The shaft 35 extends through another bearing 40 that is mounted centrally in the head 24 by a spider plate 41. The rear of the front bearing 36 is supported on a vertical wall 42 which carries a directional sensor package 43. The package 43 preferably has a reference axis that is parallel to the longitudinal axis of the shaft 35.

Figure 3:
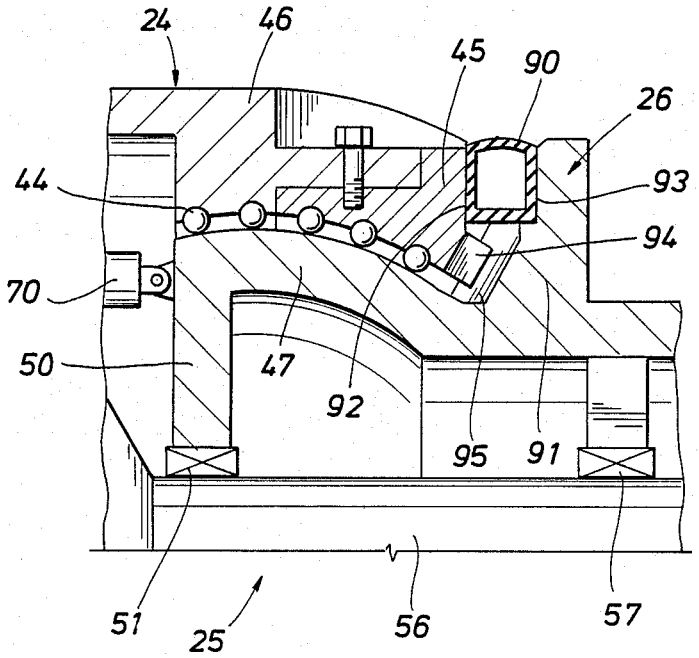
FIG. 3 is an enlarged fragmentary view showing a seal between the guide head and the housing.

The ball joint coupling 25 that connects the head 24 to the housing 26 comprises an outer spherical element 46 that is mounted on an inner spherical element 47 on the front end of the tubular housing 26. As shown in FIG. 3, a plurality of steel ball bearings 44 that ride in internal grooves in the element 46 provide smooth pivotal movement, with the balls being secured by an annular retainer 45 that is bolted in a recess in the rear portion of the element 46. To prevent fluid leakage, an annular tube-type elastomer seal element 90 is mounted on a neck 91 on the front of the housing 26. The seal element 90 can be inflated by air under pressure, so that its opposite sides engage and seal against faces 92 and 93. The element 90 is yieldable to permit pivotal movement of the guide head 24, while functioning to prevent fluid leakage into the ball joint coupling 25.

The guide head 24 can not rotate relative to the housing 26 by virtue of inclusion of lugs 94 that engage in slots 95 on the neck 91. The lengths of the lugs and slots are dimensioned such that the head 24 can assume a variety of attitudes with respect to the housing 26 in order to control or change the direction in which the borehole 10 will proceed as it is cut by the bit 23. For example, 5° of freedom can be provided for this purpose by the design of the lugs and slots, and the clearance between opposing surfaces of the retainer 45 and the neck 91.

The inner spherical element 47 has a traverse wall 50 on its front end as shown in FIG. 2A, and a third bearing 51 is used to mount the yoke 52 of a Cardan-type joint indicated generally at 53. The front element 54 of the joint 53 is connected to the rear end of the shaft 35 and cooperates with the yoke 52 to provide an articulated drive coupling. A reinforced flexible hose 55 communicates the bore of the shaft 35 with the bore of the yoke 52. The yoke 52 is threaded to the front end of a main drive shaft 56 which is mounted for rotation in spaced-apart bearings 57 and 58 that are mounted on support plates 59, 60 respectively, the plates being fixed within the housing 26. The drive shaft 56 carries a gear 62 that meshes with a pinion 63 on the input shaft of a hydraulic pump 64. The pump 64 is carried on a bracket 65 on the inner wall of the tubular housing 26, and is driven by the gearing, as described, to supply hydraulic oil under pressure via a discharge line 67 that leads to a control system 66. The control system 66, to be described in greater detail below, can be mounted on the opposite inner wall of the housing 26. Flexible hydraulic lines 68 lead from the control system 66 to a plurality of power steering cylinders 70 that are spaced outwardly of the longitudinal axis of the yoke 51. In an illustrative embodiment, a pair of cylinders 70, 70' are located in a vertical plane passing through the axis of the shaft 35, and another pair (not shown) are located in a horizontal plane that is orthogonal to the vertical plane. One end of each power cylinder 70, 70' is pivotally attached to the front face of the inner ball joint member 47, and the other ends thereof are pivotally attached to the spider plate 41. It will be recognized that selective extension and/or retraction of the various cylinders 70, 70' can be used to change the attitude of the guide head 24 with respect to the tubular housing 26, and to hold it in such attitude. A hydraulic control line 72 extends through the casing 27 alongside the air line 30, and leads to the control system 66 so that pressure signals can be transmitted to the system 66 from the rig 16 in order to selectively actuate the cylinders 70, 70' in a desired manner.

The directional sensor package 43 can comprise a known combination of magnetometers and accelerometers that provide output signals representative of components of the earth's magnetic field, from which the azimuth of the shaft 53 with respect to magnetic north, and the inclination of he shaft 53 with respect to the vertical, can be determined by routine computation. The magnetometers can be flux-gate devices, in which case it will be desirable to form the head 24, the shaft 35 and the plates 42 and 41 out of suitable nonmagnetic material. The accelerometers can be typical pendulous masses having strain gauges mounted at points of stress concentration. In any event, the output signals of the sensor package 43 are fed through an electrical conductor cable (not shown) which extends back through the casing 27 alongside the air and hydraulic hoses 30, 72.

To detect whether the guide head 24 and housing 26 have rotated within the borehole 10 such that the sensor package 43 is not on the low side of the hole, a pendulous mass (not shown) can be hung on the wall 41 from the arm of a rheostat. A voltage across the rheostat will change from a known value, due to movement of the pendulum, at any time the guide head 24 rotates about its longitudinal axis. Corrective measures can be taken by applying torque to the casing 27 to ensure that the package 43 is on the low side of the hole, or to enable corrections to be computed of the output of the sensors.

The rear end of the main drive shaft 56 is connected by an adapter 75 to the first section or joint 76 of the string of drill pipe 28. At axially spaced points along the length of the casing 27, the drill pipe 28 is supported for coaxial rotation within the casing by stabilizers 29, each having a central bearing 78 and slide shoes 79 connected by radial arms 80. The stabilizers 29 do not rotate within the casing 27, but can slide axially thereof in either longitudinal direction. The lines 30, 72 and the electric cable, described above, are formed in short lengths with connectors and quick-disconnect couplings at each end to facilitate make up, and can extend through apertures formed in the arms 80 of each stabilizer 77.

Figure 2B:
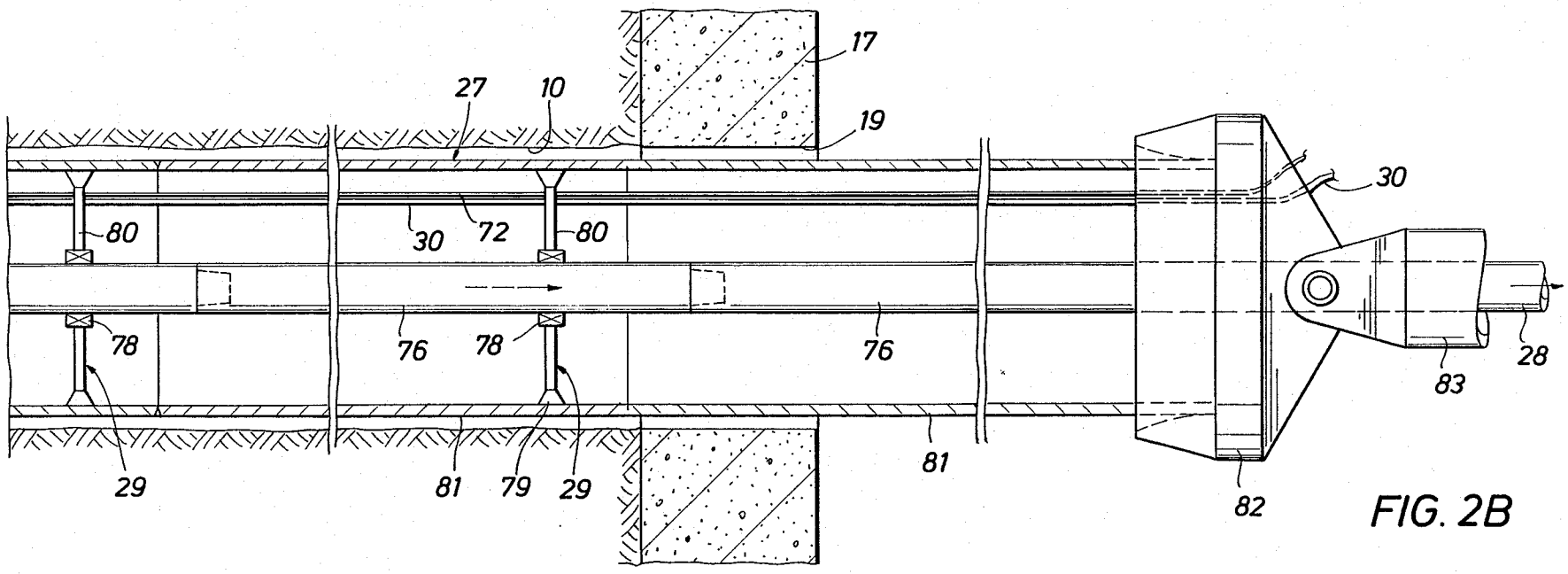

The casing string 27 is formed of a plurality of individual short sections 81 that are welded end-to-end as the drilling of the borehole 10 proceeds, as will be described in detail herebelow. As shown in FIG. 2B, the rearmost casing section 81 of the casing 27 protrudes from the pilot opening 19 in the retainer wall 18, and its outer end is engaged by the open end of a casing cup 82. The cup 82 is driven axially by powerful hydraulic rams or jacks 83 in order to thrust the entire assembly forward in a controlled manner. The axial thrust on the casing 27 forces the drill bit 23 against the outer end of the borehole 10 so that the bit will make hole as it is rotated by the drill pipe 28, and such axial force serves to drive the casing into the hole as the bit advances.

Figure 4:
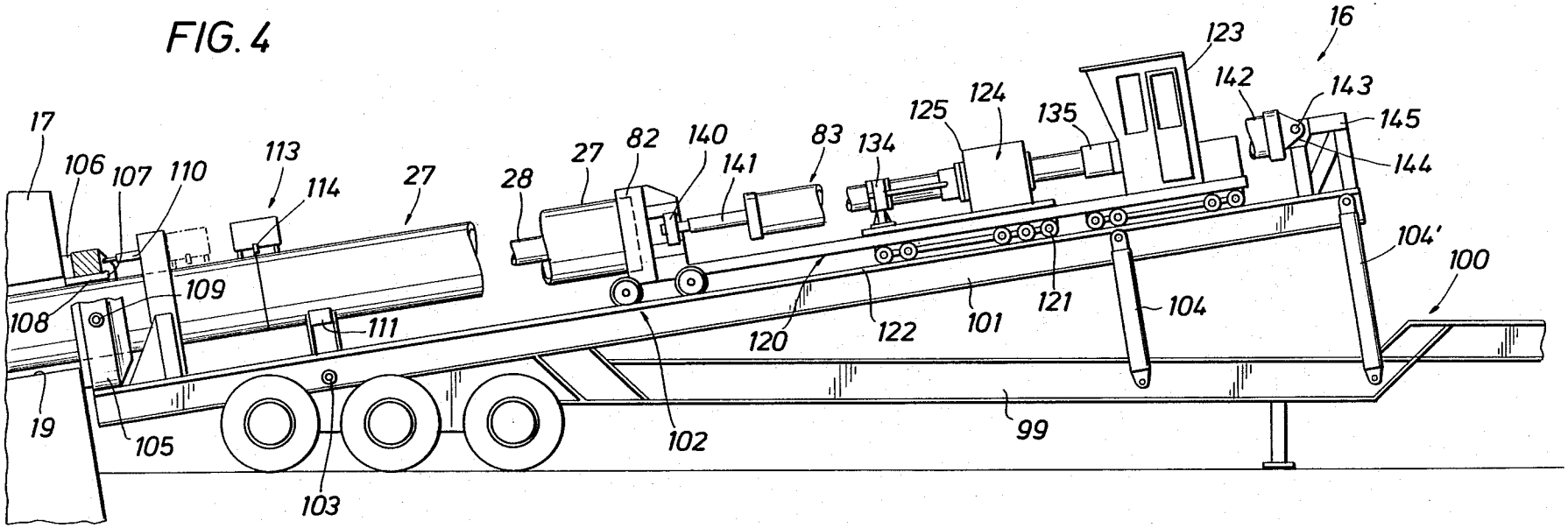
FIG. 4 is a view similar to FIGS. 2A and 2B of the above-ground of the drilling apparatus.

The above-ground installation and equipment in accordance with the present invention is shown in detail in FIG. 4. The bed 99 of the trailer 100 carries a deck 101 having a track structure indicated generally at 102 attached thereto. The deck 101 is pivotally mounted by trunnions or the like to the bed 99 at transverse axis 103 located near the rear of the bed. The front end of the deck 99 is supported by jacks 104, 104' that can be extended until the track structure and deck are at the proper angle with respect to horizontal. The rear end of the deck 101 carries an annular inlet cup 105 having an elastomer outer seal ring 106 that engages the retainer wall 17, and a stripper rubber 107 having an outwardly turned lip 108 through which the casing 27 is fed. The inlet cup 105 can be pivoted in a suitable manner about a transverse axis 109, and can be forced against the abutment wall by a hydraulic cylinder 110. The casing 27 preferably is supported by rollers 111 that are mounted at spaced locations toward the rear of the deck 101.

An automatic welding machine indicated at 113 is mounted adjacent the inlet cup 105, and includes a welding head 114 that can be moved circumferentially around a pipe abutment seam to form a joining weld. The welding machine 113 is a conventional apparatus and need not be described further herein.

Figure 5:
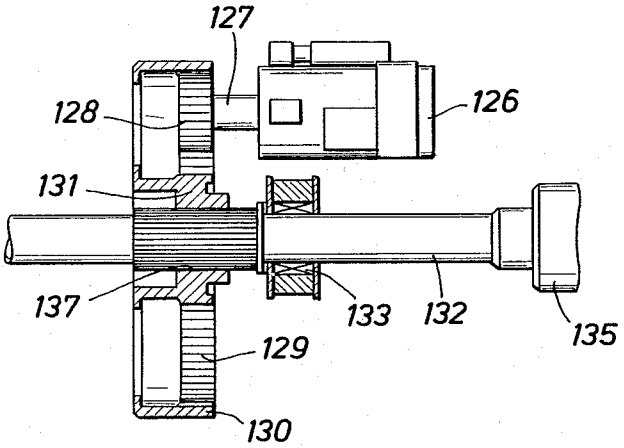
FIG. 5 is a top view, with some parts in section, of the drive apparatus shown in FIG. 4.

The casing cup 82, which has been shown schematically in FIG. 2A, is carried on the front end of a train referenced generally at 120. The train 120 has a plurality of flanged wheels 121 that run on a pair of rails 122. The rear of the train 120 comprises an operators station 123 located inside a cab, where various consoles and controls for remote operation of the various components of the present invention can be located. A drive motor assembly 124 is located in front of the cab, and a protective screen 125 is mounted over a drive apparatus shown in FIG. 5. The drive apparatus includes a high powered electric motor 126 having an output shaft 127 that carries a drive pinion 128. The pinion 128 engages gear teeth 129 on the inner periphery of a large diameter ring or "bull" gear 130 that has a hub 131 which is splined at 137 to a drill string drive shaft 132. A rear bearing 133 is provided to mount the shaft 132, together with a front bearing that is carried in a pillow block 134 or the like. A flow swivel 135 is mounted at the rear end of the drive shaft 132 to enable return fluids from the drilling process to be piped out to the side as the shaft is rotated. Although a single electric motor 126 is shown in FIG. 5, a second motor can be located on the opposite side of the drive shaft 132 and have a pinion in engagement with the bull gear 130 in order to double the power input. It also is possible to provide a bull gear with a set of gear teeth that is the mirror image of that shown in FIG. 5, and to provide two more drive motors having output pinions in engagement therewith in order to quadruple the power input to the drive shaft 132.

Figure 6:
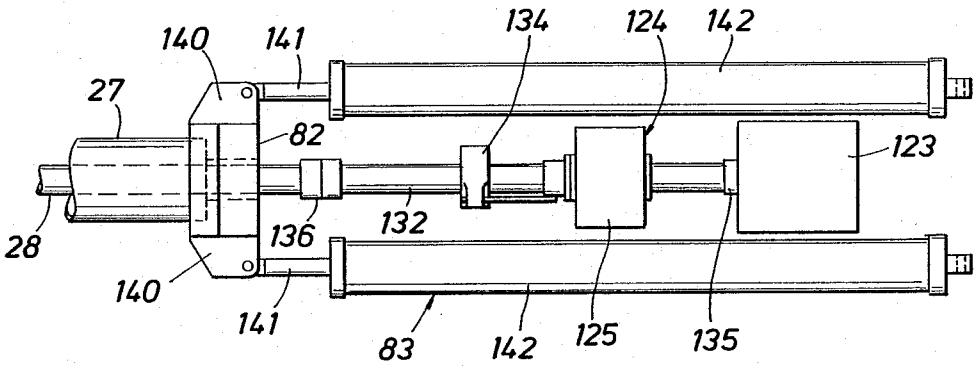
FIG. 6 is a top plan view of the hydraulic jacks and associated equipment used to thrust the casing into the borehole.

As shown in FIG. 6, the front end of the drive shaft 132 has a tool joint connection 136 to the rear section of the drill pipe 28. The casing cup 82 has a pair of outwardly extending ears 140 to which the rod ends 141 of the hydraulic jacks 83 are pinned. The cylinders 142 of the jacks 83 are pinned at 143 to a cross-member 144 (FIG. 4) of a strong bracket 145 which is attached to the deck 101 at the front end thereof. The jacks 83 can be simultaneously extended by the application of hydraulic pressure to the pistons inside the cylinders 142, in order to apply a large thrust force to the outer end of the casing 27 as the motor 126 drives the shaft 132, the drill pipe string 28, and thus the bit 23 in rotation. Although not shown, it is desirable that the trailer 100 be anchored against rearward movement as the jacks are extended. Any suitable means may be employed, such as braces that extend from the trailer chassis and a retaining wall constructed in front of the trailer 100.

Figure 7:
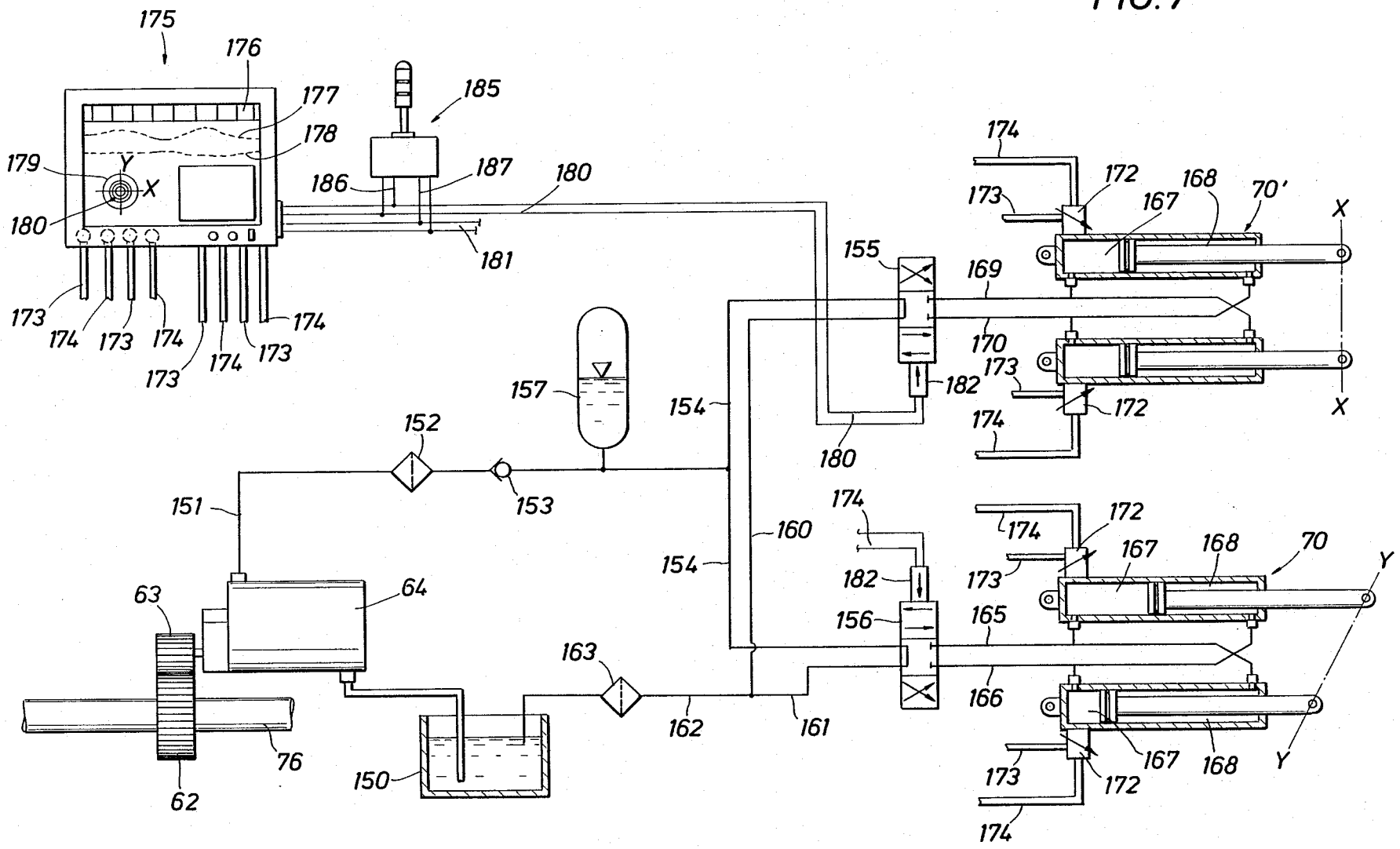
FIG. 7 is a schematic illustration of a hydraulic circuit an components used to steer the drilling head and bit of the present invention.

A hydraulic circuit and various related components used to control the steering cylinders 70, 71' are shown schematically in FIG. 7. The pump 64, which is a pressure compensated device, draws hydraulic fluid from a reservoir 150 and feeds it under pressure to a discharge line 151. The fluid passes through a filter 152 and a check valve 153 to lines 154 that lead to servo valves 155 and 156. An accumulator 157 provides a temporary source of pressure at times when there is no rotation of the drill pipe 76, so that the pump 64 is not being driven by the gears 62 and 63. Return lines 160 and 161 lead from the servo valves 155 and 156 to a common line 162 that returns hydraulic fluid to the reservoir 150 via a filter 163.

Lines 165 and 166 connect the output of the servo valve 156 to the respective opposite ends 167 and 168 of the first pair of steering cylinders 80, and lines 169 and 170 make the same connection to the opposite ends of the second pair of cylinders 70' as shown. As previously mentioned, the pair of cylinders 70 lie in the vertical plane passing through the longitudinal axis of the bit drive shaft 43, and the pair of cylinders 70' lie in a horizontal plane through such axis that is orthogonal to such vertical plane. Each cylinder 70 or 70' can be, for example, of the type offered by the Cylinder division of Parker Hannifin Corp., Des Plaines, Illinois, designated a Series 2HX having a LDT-F linear displacement transducer feedback element 172 for accurate control of the cylinder position. Two pairs of conductor wires 173 and 174 run from each LDT-F element 172 to the inputs of a computer and display unit 175 which functions to keep the path of the borehole 10 on course with respect to set values of azimuth and inclination The upper part 176 of the display is constituted by a distance scale, and below that are graphic displays 177 and 178 of a predetermined path as viewed from the side, and such predetermined path as viewed from above. The lower left-hand portion of the display is shown as a set of coordinates 179, with the computer providing a dot 180 representation of the actual heading of the bit 23 in degrees of inclination from the horizontal, and azimuth with respect to magnet North. One of the pairs of conductor wires 174 that leads to each LDT-F unit 172 provides signals to the computer 175 representative of actual cylinder position, whereas the other pair of the wires 173 provides exciter signals from the computer 175.

Pairs of conductor wires 180 and 181 lead from the computer 175 to controls 182 on the respective servo valves 155 and 156 in order to cause the servo valves to momentarily enable high pressure hydraulic fluid to be supplied to the respective rod or cylinder ends of the hydraulic cylinders 70, 70', as well as the exhaust of fluid from the opposite ends thereof, in order to cause extension of one cylinder of each pair, and retraction of the other, which will result in the application of moments to the guide head 24 and the housing 26 to effect a course correction.

If for any reason the system described above does not provide automatic control over the steering of the drill bit 23, a manual override is provided in the form of "joy-stick" control 185. This device, which can be of the type offered by P-Q Controls, Inc., Bristol, Conn. as its multi-axis control Model 220-04, is connected by pairs of conductor wires 186 and 187 to the respective pairs 180 and 181 previously described. Thus the steering of the bit 23 can be controlled manually whenever it is desired to do so.

OPERATION

In operation, the surface location 11 where the borehole 10 is to be started is excavated to a depth, length and width as necessary to permit placement of the trailer-mounted drill rig 16. A concrete retainer wall 17 is formed and poured, having a pilot opening 19. The rig 16 then is backed into position by a tractor (not shown), and the deck 101 is pivoted upward to the position shown in FIG. 4, where it is fixed by the jacks 104, 104'. Suitable braces (not shown) are placed between the trailer chassis and a front abutment to prevent forward movement of the trailer 100. The hydraulic rams 83 are retracted, so that the train 120 is at the upper end of the track 122. The bit 23, guide head 24 and housing 26, with a section of the casing 27 already welded thereto, are positioned on the support rollers 111 between the inlet cup 105 and the casing cup 82. The elastomer seal ring 106 is forced against the surface of the retainer wall 17 that surrounds the pilot opening 19, and then the jacks 83 are extended to advance the bit, guide head and housing through the stripper rubber 107 until the bit 23 engages the earth. Rotation of the drill string 28, and air circulation, are established, and drilling of the borehole 10 is begun. Initially the guide head 24 will be axially aligned with the housing 26 so that the borehole is drilled straight ahead.

After the borehole 10 has been drilled for a distance equal to one section of the casing 27, so that the casing cup 82 has been advanced close to the inlet cup 105, the drive motor 126 is stopped and the tool joint 136 is disconnected, along with the air line, hydraulic lines, and electric cable bundle. The train 120 then is backed up by retraction of the jacks 83, and another section 81 of casing 27 is layed in position on the rollers 111. A section of drill pipe 28 mounted on stabilizers 29 is inserted into the casing section 81, and the pin and box connection made up by power tongs or the like. Additional sections of air line, hydraulic hoses, and electrical cable are connected to the outer ends of those already in place, and the outer ends of the additional lines are fed out through a opening in the casing cup 82 and connected to their respective sources. The tool joint 136 is made up to connect the drill pipe with the drive shaft 132. With circulation established and the bit 23 rotating, the jacks 83 are extended to cause the bit to drill further into the earth and thereby lengthen the borehole 10. The foregoing cycle is repeated again and again as new sections of casing are added and welded to the outer end of the previously installed casing, and additional lengths of drill pipe supported by stabilizers, and hydraulic and pneumatic lines, are added.

The output of the directional sensor 43 is monitored continuously, and a map may be constructed to show the actual underground course or trajectory of the borehole 10. As course corrections are needed, signals are sent automatically through the lines 180 and 181 to cause extension and retraction forces to be applied to the guide head 24 by the steering cylinders 70 and 70'. As drilling proceeds, these forces cause gradual changes to be made in the path of borehole 10. In a sense, the guide head 24 and bit 23 are "steered" by remote control in order to ensure that the borehole stays on the desired course. The manual override or "joy-stick" 185 can be manipulated, if desired, to effect course corrections.

The borehole 10 is thus cased, or lined, during the drilling thereof in a single pass operation. Eventually the bit 23, guide head 24 and housing 25 will emerge from the ground at the location 12 on the other side of the obstacles such as 13. These members then are disconnected from the casing string 27, by a cutting torch or the like, and removed from the excavation at location 12. Then the jacks 83 can be used with a suitable coupler to withdraw the drill string 28 along with its centralizers 29 from the casing 27, section by section. With the drill string 28 removed, a cased borehole has been formed along a curved path under the surface obstruction.

As previously mentioned, ground water in areas where the water table is high will seep into and tend to fill the borehole 10 to some extent. However the circulation of air out the jets 39 in the bit 23 and back into the bore of the drill string 28 carries the water therewith and removes it from the hole. Any water present may be considered to be desirable because it lends buoyancy to the casing string 27, and tends to provide lubrication so that the casing slides readily forward under the thrust of the jacks 83.

It now will be recognized that new and improved methods and apparatus have been provided for forming a cased borehole underneath a ground obstruction in a single pass. Since numerous changes or modifications may be made in the disclosed embodiment without departing from the inventive concepts involved, it is the aim of the appended claims to cover all such changes and modifications falling within the true spirit and scope of the present invention.

What is claimed is:

1. A method for forming a cased borehole that extends underground beneath one or more surface obstructions, said cased borehole being formed in a single pass, comprising the steps of: providing a rotary drill bit on the outer end of a tubular guide head that has an articulated coupling to a tubular housing in a manner that allows multiple degrees of freedom of movement of the guide head with respect to the housing; attaching a length of casing to said housing which extends outwardly to the mouth of the borehole and through which axial thrust is applied to said housing, said guide head and said bit, the outer diameter of said casing being slightly smaller than the outer diameter of said bit; positioning a length of drill pipe inside said casing, and coupling said drill pipe to said bit; rotating said drill pipe in order to cause rotation of said bit; applying axial thrust to said casing which is transferred by said housing and guide head to said bit to cause said bit to lengthen the borehole and said casing to advance into the borehole behind said housing; and steering said guide head with respect to said housing to cause said borehole to proceed along a desired course.

2. The method of claim 1 including the further step of centralizing said drill pipe within said casing at longitudinally spaced points along the length thereof.

3. The method of claim 2 including the further steps of piping pressurized air through said casing, and causing said air to emanate from jets in said bit to cool same and carry cuttings back to the entrance of the borehole through said drill pipe.

4. The method of claim 1 including the step of continuously monitoring the azimuth and inclination of said borehole adjacent said guide head, said steering step being performed as necessary to cause the borehole to proceed along a desired course.

5. The method of claim 4 wherein said steering step is accomplished by applying moments to said guide head and housing about the center of said articulated coupling therebetween.

6. The method of claim 1 including the repetitive steps of placing additional sections of casing and drill pipe adjacent the outer ends of those previously run, connecting adjacent ends of such additional sections to the outer ends of the sections previously run, and again rotating the drill pipe while applying axial thrust to the casing in order to progressively lengthen the borehole.

7. The method of claim 6 including the steps of: causing the guide head and housing to emerge from the ground on the opposite side of said obstruction; and disconnecting said guide head and said housing from the forward end of the casing; leaving the casing in place in the borehole.

8. The method of claim 7 including the additional step of: removing the drill pipe from the casing to provide an unobstructed casing bore.

9. The method of claim 5 wherein said moments are applied in response to selective extension and retraction of hydraulic cylinder means connected between said guide head and said housing in laterally spaced relation to the axis of rotation of said bit.

10. The method of claim 9 including the steps of: providing a source of hydraulic fluid pressure that is connected to said hydraulic cylinder means; and selectively extending and retracting said cylinder means in response to remotely applied control signals.

11. The method of claim 10 including the further steps of: sensing the position of said hydraulic cylinder means; and controlling said position of said cylinder means in response to information obtained in said sensing step.

12. The method of claim 1 including the further steps of: detecting at said guide head the actual direction of the borehole; comparing said detected direction with a desired direction; and automatically steering said guide head toward said desired direction if said detected direction does not correspond to said desired direction.

13. The method of claim 1 including the further step of: detecting at said guide head the actual direction of the borehole; comparing said detected direction with a desired direction; and providing signals from a manually operated control operable to steer said guide head to a desired direction if said detected direction does not correspond to said desired direction.

14. The method of claim 10 wherein said source of hydraulic fluid pressure is a pump mounted in said housing, and including the additional step of: operating said pump in response to rotation of said drill pipe.

15. The method of claim 4 including the step of: sensing the rotational orientation of said guide head with respect to the low side of the borehole.

16. The method of claim 15 including the further step of maintaining the rotational orientation of said guide head in a selected position with respect to said low side.

17. The method of claim 2 wherein said centralizing is accomplished by centralizer members that are each slidable within said casing, and including the additional steps of: causing said guide head and housing to emerge from the ground on the opposite side of said obstruction; disconnecting said guide head and said housing from the forward end of said casing; and then pulling said drill pipe and said centralizer members out of said casing to provide an unobstructed casing bore.

18. The method of claim 1 including the further step of: sealing the annular space between the entrance end of said borehole and the outer surface of said casing.

19. The method of claim 1 wherein said axial thrust is applied by jacking against the rearward end of said casing at a location adjacent the entrance end of said borehole.

20. Apparatus for drilling and casing a curved borehole through the earth underneath one or more surface obstructions in a single pass, comprising: a guide head; a rotary drill bit on said head; a tubular housing having front and rear ends; means for attaching said rear end of said housing to a well casing that extends outward to the entrance of the borehole; ball-joint means for coupling said front end of said housing to said head in a manner that permits multiple degrees of freedom of movement of said guide head with respect to said housing; sensor means on said head for providing an indication of the direction in which said bit is headed; means for applying a moment to said head and said housing about the center of said ball joint means tending to cause said bit to drill along a desired direction; and drive shaft means concentrically arranged within and extending through said housing for rotating said drill bit.

21. The apparatus of claim 20 wherein said drill bit is mounted for rotation on a tubular member extending into said guide head; a drive shaft mounted in said housing; and universal joint means for connecting said drive shaft to said tubular member, said universal joint means having an articulation point that substantially coincides with the center of said ball joint means.

22. The apparatus of claim 21 wherein said drive shaft and said tubular member are hollow to provide a fluid flow path, and further including flexible conduit means for communicating the rear end of said tubular member with the front end of said drive shaft to enable passage therethrough of a circulating medium.

23. The apparatus of claim 22 wherein said moment applying means comprises hydraulic cylinder means connected between points on said guide head and said housing, at least one of said points being laterally offset from the axis of rotation of said tubular member.

24. A drilling rig for use in drilling a borehole underneath a surface obstruction with a drill bit mounted on a guide head having a ball joint coupling to a tubular body, comprising: an elongated platform having a track thereon; train means on said track; said train means including a casing cup adapted to engage the outer end of a casing; jack means for moving said train means along said track to cause said cup to apply axial thrust to said casing; a drill string drive shaft mounted on said train means coaxial with the longitudinal axis of said cup; and motor means for rotating said drive shaft as said jack means applies axial thrust to said cup.

25. The rig of claim 24 wherein said jack means comprises a pair of parallel hydraulic cylinders located on opposite sides of said drive shaft, one end of each cylinder being attached to said platform and the other end thereof being attached to said cup.

26. The rig of claim 25 further including a ring gear surrounding said drive shaft and having a spline connection thereto, said motor means having an output shaft with a pinion thereon, said pinion meshing with said ring gear.

27. The rig of claim 26 further including a flow swivel mounted on one end of said drive shaft for directing fluids passing through said drive shaft out of said end.

28. The rig of claim 27 wherein said platform is pivotally mounted on the bed of a trailer, whereby one end of said pattern can be elevated to permit said axial thrust to be applied to a casing at an angle to the horizontal.

29. Apparatus for drilling and casing a curved borehole through the earth underneath one or more surface obstructions, comprising: a guide head; a rotary drill bit on said head; a tubular housing; ball-joint means for coupling said housing to said head; sensor means on said head for providing an indication of the direction in which said bit is headed; means for applying a moment to said head and said housing about the center of said ball-joint means tending to cause said bit to drill along a desired direction, said drill bit being mounted for rotation on a tubular member that extends into said guide head; a drive shaft mounted in said housing; universal joint means for connecting said drive shaft to said tubular member, said universal joint means having an articulation point that substantially coincides with the center of said ball-joint means, said drive shaft and said tubular member being hollow to provide fluid flow path; flexible conduit means for communicating the rear end of said tubular member with the front end of said drive shaft to enable passage therethrough of a circulating medium; said moment applying means including hydraulic cylinder means connected between points on said guide and said housing, at least one of said points being laterally offset from the axis of rotation of said tubular member; hydraulic pump means mounted in said tubular housing, said pump means having an input gear; gear means mounted on said drive shaft in mesh with said input gear for driving said pump means in response to rotation of said shaft; and control means for selectively applying the output of said pump means to said hydraulic cylinder means to cause selective extension and retraction thereof.

30. The apparatus of claim 29 wherein said moment applying means comprises at least one pair of hydraulic cylinders, each of said cylinders being mounted between axially spaced points on said guide head and said housing that are located radially outward of the rotation axis of said tubular member.

31. The apparatus of claim 29 wherein said moment applying means comprises two pairs of hydraulic cylinders, one of said pairs of cylinders being attached between said housing and said guide head so as to lie in a first plane passing through the axis of rotation of said tubular member, the other of said pairs of cylinders being attached between said housing and said guide head so as to lie in a second plane passing through the axis of rotation of said tubular member, said second plane being orthogonal to said first plane.

32. The apparatus of claim 24 further including casing means fixed to said body housing extending rearwardly thereof; pipe means in said casing and connected to said drive shaft for imparting rotary motion thereto; and centralizer means for mounting said pipe means within said casing means.

33. The apparatus of claim 32 wherein said centralizer means includes shoes in sliding contact with inner wall surfaces of said casing means to permit longitudinal movement of said centralizer means and said pipe means within said casing means when said pipe means is disconnected from said drive shaft.

34. The apparatus of claim 32 including means for applying axial thrust to said casing means as said pipe means is employed to rotate said drill bit to cause said drill bit to form the borehole.

35. The apparatus of claim 34 further including motor means for rotating said pipe means to cause corresponding rotation of said drive shaft, universal joint means, member and drill bit.

36. The apparatus of claim 29 wherein said drill bit includes a body; a plurality of jets in said body; and further including conduit means for supplying air under pressure to said jets to effect cooling of said bit and to carry away cuttings of the bit into and through the interiors of said tubular member and said drive shaft.

37. Apparatus for drilling and casing a curved borehole through the earth underneath one or more surface obstructions, comprising: a guide head; a rotary drill bit on said head; a tubular housing; ball-joint means for coupling said housing to said head; sensor mans on said head for providing an indication of the direction in which said bit is headed; means for applying a moment to said head and said housing about the center of said ball-joint means tending to cause said bit to drill along a desired direction, said drill bit being mounted for rotation on a tubular member that extends into said guide head; a drive shaft mounted in said housing; universal joint means for connecting said drive shaft to said tubular member, said universal joint means having an articulation point that substantially coincides with the center of said ball-joint means, said drive shaft and said tubular member being hollow to provide a fluid flow path; flexible conduit means for communicating the rear end of said tubular member with the front end of said drive shaft to enable passage therethrough of a circulating medium; said moment applying means including hydraulic cylinder means connected between points on said guide head and said housing, at least one of said points being laterally offset from the axis of rotation of said tubular member; pump means for supplying hydraulic fluid under pressure to the opposite ends of said cylinder means; servo valve means for directing the supply of hydraulic fluid; and remotely operable control means for selectively operating said servo valve means to change the position of said cylinder means.

38. The apparatus of claim 37 further including means for detecting the position of said cylinder means and for communicating such position to said control means.

39. The apparatus of claim 38 wherein said sensor means comprises first means for providing an output indicative of the inclination of said direction with respect to horizontal, and second means for providing an output indicative of the azimuth of said direction with respect to magnetic North.

40. The apparatus of claim 39 further including means for providing an indication of the rotational orientation of said guide head with respect to the low side of the borehole.

* * * * *